US011135838B2

(12) United States Patent
Hatsui et al.

(10) Patent No.: US 11,135,838 B2
(45) Date of Patent: Oct. 5, 2021

(54) LIQUID EJECTION HEAD AND METHOD OF MANUFACTURING SAME

(71) Applicant: CANON KABUSHIKI KAISHA, Tokyo (JP)

(72) Inventors: Takuya Hatsui, Tokyo (JP); Souta Takeuchi, Fujisawa (JP); Masataka Kato, Hiratsuka (JP); Masaya Uyama, Kawasaki (JP); Toru Nakakubo, Kawasaki (JP); Tomohiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 16/422,342

(22) Filed: May 24, 2019

(65) Prior Publication Data

US 2019/0366713 A1 Dec. 5, 2019

(30) Foreign Application Priority Data

May 30, 2018 (JP) ..... JP2018-103909

(51) Int. Cl.
*B41J 2/14* (2006.01)
*B41J 2/175* (2006.01)
*B41J 2/16* (2006.01)

(52) U.S. Cl.
CPC ..... *B41J 2/14072* (2013.01); *B41J 2/1623* (2013.01); *B41J 2/175* (2013.01); *B41J 2/1753* (2013.01); *B41J 2/17526* (2013.01); *B41J 2/14* (2013.01); *B41J 2002/14491* (2013.01)

(58) Field of Classification Search
CPC .. B41J 2/14072; B41J 2/1753; B41J 2/17526; B41J 2/17546; B41J 2002/14491; B41J 2/175; B41J 2/14
See application file for complete search history.

(56) References Cited

U.S. PATENT DOCUMENTS

2008/0165222 A1* 7/2008 Hayakawa et al. .. B41J 2/14072
2011/0059558 A1* 3/2011 Takeuchi et al. .... B41J 2/14072

FOREIGN PATENT DOCUMENTS

JP 2003-136721 A 5/2003
JP 2007-326340 A 12/2007
JP 2016-92400 A 5/2016

* cited by examiner

*Primary Examiner* — Henok D Legesse
(74) *Attorney, Agent, or Firm* — Canon U.S.A., Inc. I.P. Division

(57) ABSTRACT

A liquid ejection head including an element substrate including an ejection port, an energy generating element generating energy to eject a liquid from the ejection port, and a terminal electrically connected to the energy generating element, and an electric connection member connected to the terminal and that supplies electric power to the energy generating element. The element substrate includes a hole portion drilled from a surface of the element substrate opposite a surface of the element substrate in which the ejection port is provided to the terminal. A sealing member is provided inside the hole portion, the sealing member covering a connection portion. The liquid ejection head further includes a fixing member in contact with the surface of the element substrate in which the ejection port is formed, the fixing member being provided at a position corresponding to the hole portion.

19 Claims, 8 Drawing Sheets

LIQUID EJECTION HEAD AND METHOD OF MANUFACTURING SAME

BACKGROUND OF THE INVENTION

Field of the Invention

The present disclosure relates to a liquid ejection head and a method of manufacturing the same.

Description of the Related Art

In recent years, recording using an ink jet recording apparatus is performed not only on a paper medium but also on a non-paper medium such as a substrate and, accordingly, high reliability as an industrial device is required in an ink jet recording apparatus.

An ink jet head includes energy generating elements that apply pressure to ink. The ink to which pressure has been applied is ejected to an external portion as ink droplets through ejection ports, and an image and the like is formed by applying the ink droplets on a medium such as paper. Electric connection portions (electrode pads) that supply electric power from the outside to drive the energy generating elements are formed in element substrates in which the energy generating elements are formed. The electric connection portions are sealed with sealing members formed of a resin material or the like to prevent adhesion of ink.

Since there are cases in which the printing quality becomes degraded due to adhesion and fixing of the ink droplets to portions near the ejection ports, a cleaning operation that removes the adhered ink droplets needs to be performed with a blade-like member. The ink droplets are removed by moving the blade member urged against the vicinities of the ejection ports of the element substrates. In so doing, there are cases in which the blade member abutting against the sealing members of the electric connection portions influences the cleaning.

Accordingly, considering the cleaning described above, for example, it is desirable that the electric connection portions are provided in a surface in which the ejection ports are not formed. Japanese Patent Laid-Open No. 2007-326340 proposes an element substrate in which electric connection portions are formed in an area on the opposite side (hereinafter, referred to as a back surface side of the element substrate) with respect to the surface in which the ejection ports are provided.

SUMMARY OF THE INVENTION

An aspect of the present disclosure is a liquid ejection head including an element substrate including an ejection port that ejects a liquid, an energy generating element that generates energy to eject the liquid from the ejection port, and a terminal electrically connected to the energy generating element; and an electric connection member that is connected to the terminal and that supplies electric power that drives the energy generating element to the energy generating element from a portion external to the element substrate. In the liquid ejection head, the element substrate includes a hole portion drilled from a surface of the element substrate opposite a surface of the element substrate in which the ejection port is provided to the terminal, and a sealing member is provided inside the hole portion, the sealing member covering a connection portion between the terminal and the electric connection member. The liquid ejection head further includes a fixing member in contact with the surface of the element substrate in which the ejection port is formed, the fixing member being provided at a position corresponding to the hole portion.

Furthermore, another aspect of the present disclosure is a method of manufacturing a liquid ejection head that ejects a liquid including preparing an element substrate that includes, on a first surface, an energy generating element that generates energy that ejects the liquid, and a terminal connected to the energy generating element through a wiring layer; forming a hole portion by etching from a second surface to the first surface, the second surface being a surface of the element substrate opposite the first surface; connecting the terminal and an electric connection member to each other by inserting a tool inside the hole portion; and covering a connection portion between the terminal and the electric connection member with a sealing member by injecting the sealing member inside the hole portion.

Further features of the present disclosure will become apparent from the following description of exemplary embodiments with reference to the attached drawings.

DESCRIPTION OF THE EMBODIMENTS

Surfaces of the sealing member that seals the electric connection portion and the element substrate are in close contact with each other, and entering of the liquid to the electric connection portion is prevented. However, the adhesion between the surfaces of the sealing member and the element substrate may be impaired caused by a change in the environment such as a change in temperature or humidity, or force or the like applied during cleaning of the liquid ejection head. In such a case, ink mist or a liquid from an ink flow path traveling and flowing along the back surface of the element substrate may enter into a portion between the sealing member and the element substrate and reach the electric connection portion and, accordingly, the reliability of the electric connection portion may be affected.

In view of the above circumstances, the present disclosure provides a liquid ejection head that is capable of obtaining reliability against the liquid in the electric connection portion of the element substrate.

Hereinafter, liquid ejection heads according to example embodiments of the present disclosure and a manufacturing method thereof will be described with reference to the drawings. Note that the following description does not limit the scope of the present disclosure. In the example embodiments, while a thermal method that ejects liquid by creating an air bubble with a heating element is employed as an example, the present disclosure can be used in liquid ejection heads employing a piezoelectric method and other various liquid ejecting methods. Furthermore, while the liquid ejection head of the example embodiments is a so-called page-wide head that has a length corresponding to the width of the printed medium, the present disclosure can be applied to a so-called serial liquid ejection head that performs recording while scanning the printed medium. The serial liquid ejection head includes a configuration in which a single printing element substrate for black ink and a single printing element substrate for chromatic color ink are mounted, for example. However, not limited to the above, a short head that has a length shorter than the width of the printed medium and that includes a plurality of element substrates arranged in an ejection port array direction so as to overlap the ejection ports may be fabricated, and the short head may be configured to scan the printed medium.

First Example Embodiment

Description of Liquid Ejection Head

Figure 1:
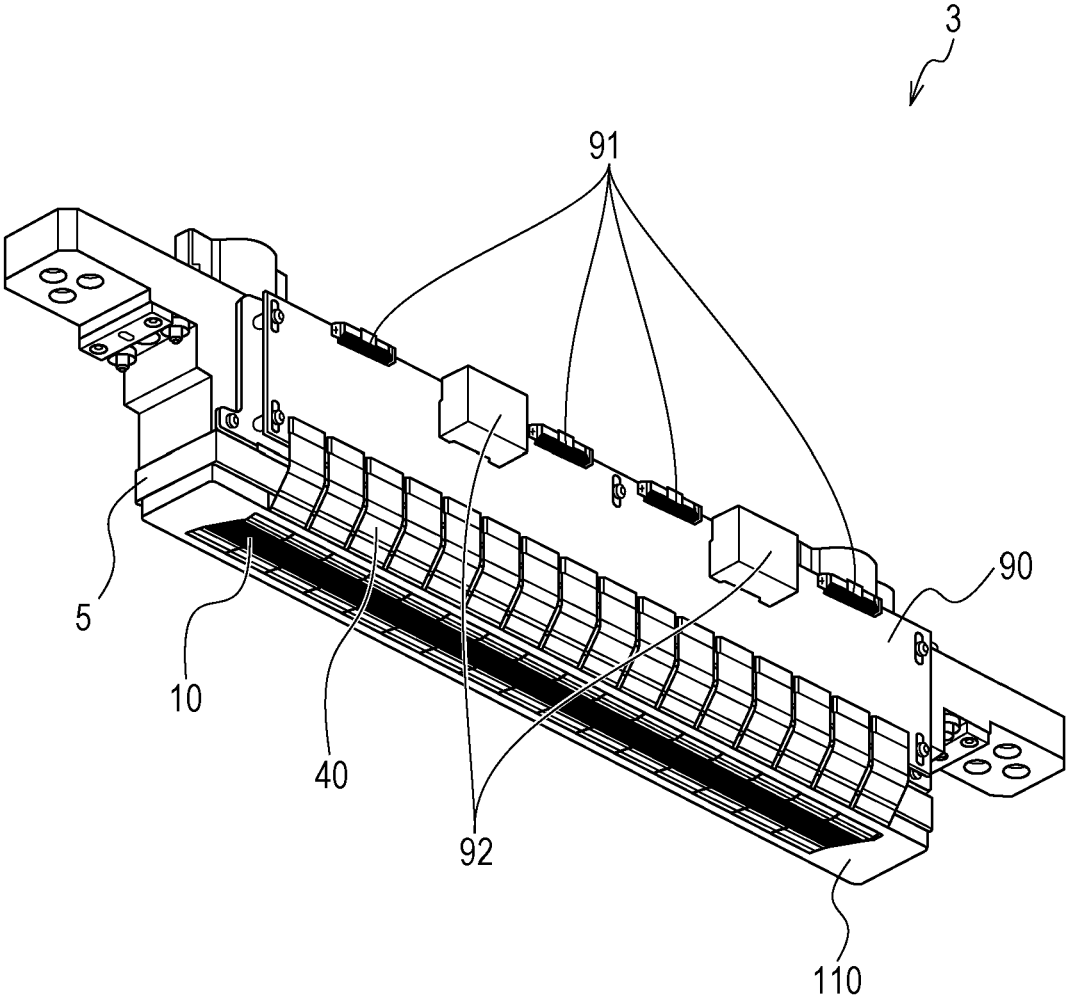
FIG. 1 is a perspective view of a liquid ejection head according to a first example embodiment.

Referring to FIGS. 1 to 3B, a description of a liquid ejection head according to the present example embodiment will be given. FIG. 1 is a perspective view of a liquid ejection head 3 according to the present example embodiment. As illustrated in FIG. 1, the liquid ejection head 3 is a page-wide liquid ejection head in which 15 element substrates 10, each element substrate 10 being capable of ejecting inks of four colors, namely, C, M, Y, and K, are linearly arranged (an in-line arrangement). The liquid ejection head 3 includes signal input terminals 91 and power supply terminals 92 that are electrically connected to the element substrates 10 through electric wiring members 40 and plate-shaped electric wiring substrates 90. The electric wiring members 40 are flexible wiring substrates, for example. The signal input terminals 91 and the power supply terminals 92 are electrically connected to a conveying unit (not shown) that conveys a printed medium (not shown) and a control unit of a recording apparatus (not shown) that includes the liquid ejection head 3 and supply an ejection drive signal and electric power needed for the ejection to the element substrates 10. By integrating the wiring with electric circuits in the electric wiring substrates 90, the number of signal input terminals 91 and the number of power supply terminals 92 can be less than the number of element substrates 10. With the above, the number of electric connection portions that need to be removed when installing the liquid ejection head 3 in the recording apparatus or when replacing the liquid ejection head 3 can be small.

Figure 2A:
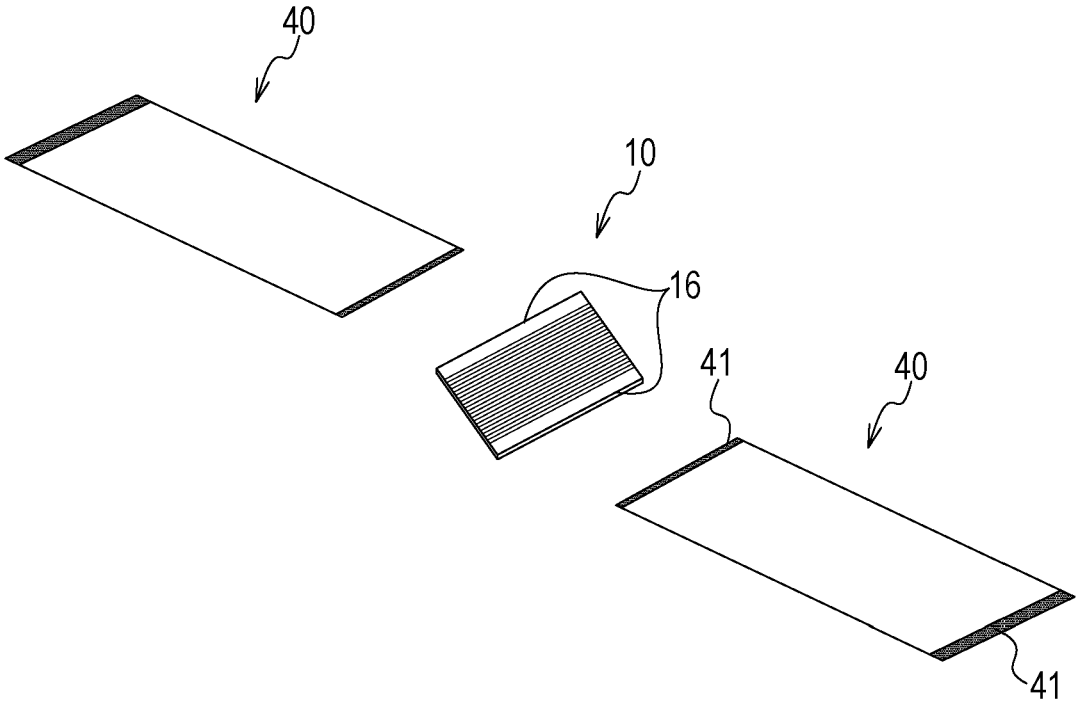
FIG. 2A is a perspective view of an element substrate and electric wiring members before the element substrate and the electric wiring members are connected to each other.
Figure 2B:
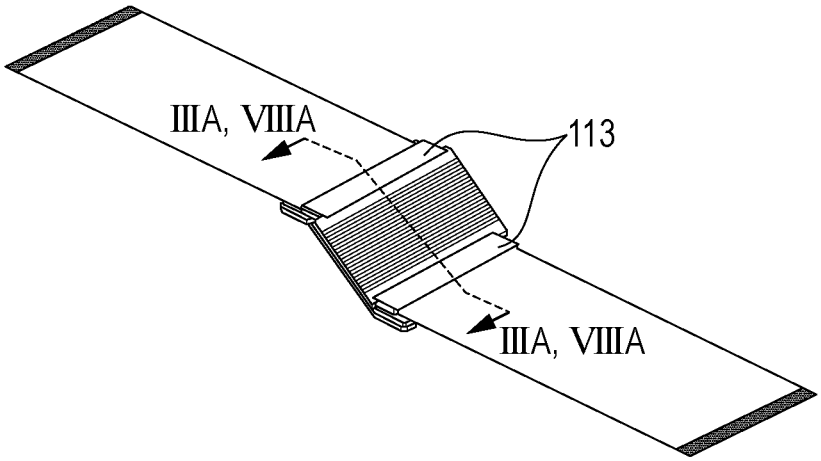
FIG. 2B is a perspective view of the element substrate and the electric wiring members after the element substrate and the electric wiring members have been connected to each other.

FIGS. 2A and 2B are perspective views of a single element substrate 10 and the electric wiring members 40 among the plurality of element substrates 10 and the electric wiring members 40 provided in the liquid ejection head 3, and illustrate a back surface side with respect to the surface in which the ejection ports of the element substrate 10 are provided. FIG. 2A is a perspective view before the element substrate 10 and the electric wiring members 40 are connected to each other. FIG. 2B is a perspective view in which each of the members are connected to each other. Note that in FIGS. 2A and 2B, an illustration of a liquid flow path member 120 (FIG. 3A) is omitted to facilitate the description. As illustrated in FIG. 2A, the element substrate 10 includes terminals 16, and each electric wiring member 40 includes terminals 41 (other terminals). The terminals 16 and the terminals 41 are electrically connected to each other through the electric connection members 112 (FIGS. 3A and 3B) by wire bonding described later, and the joining portions are covered by sealing members 113 (FIG. 2B).

Figure 3A:
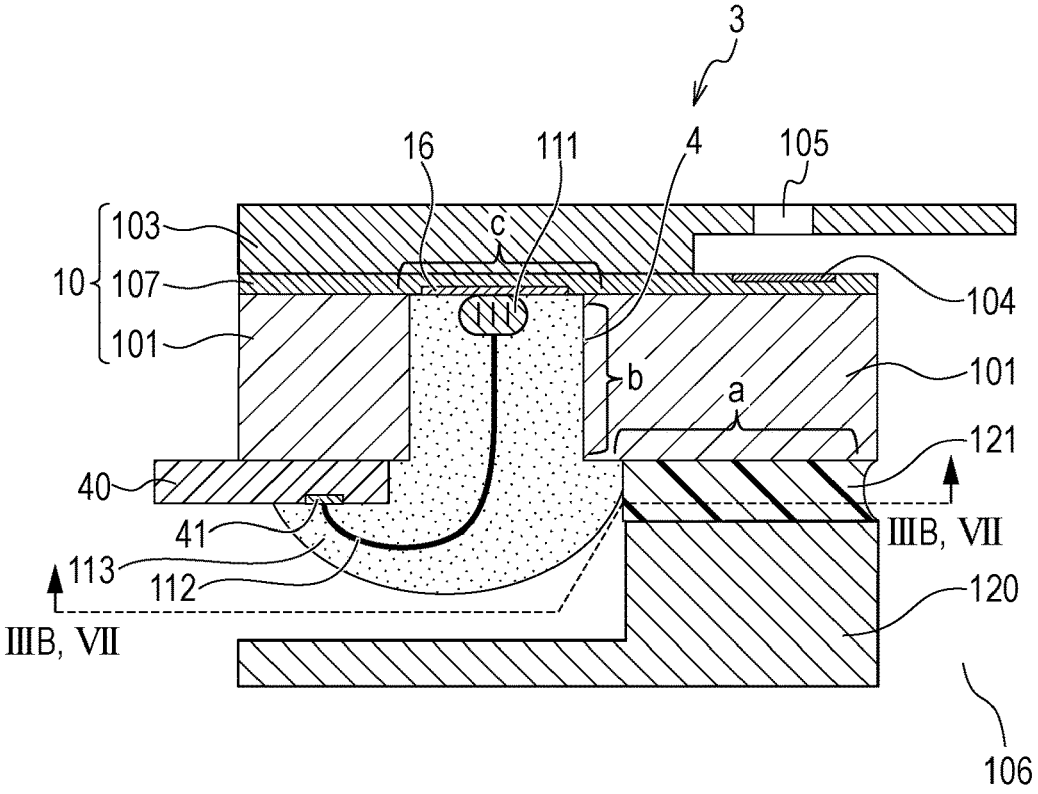
FIG. 3A is a schematic view of the liquid ejection head.
Figure 3B:
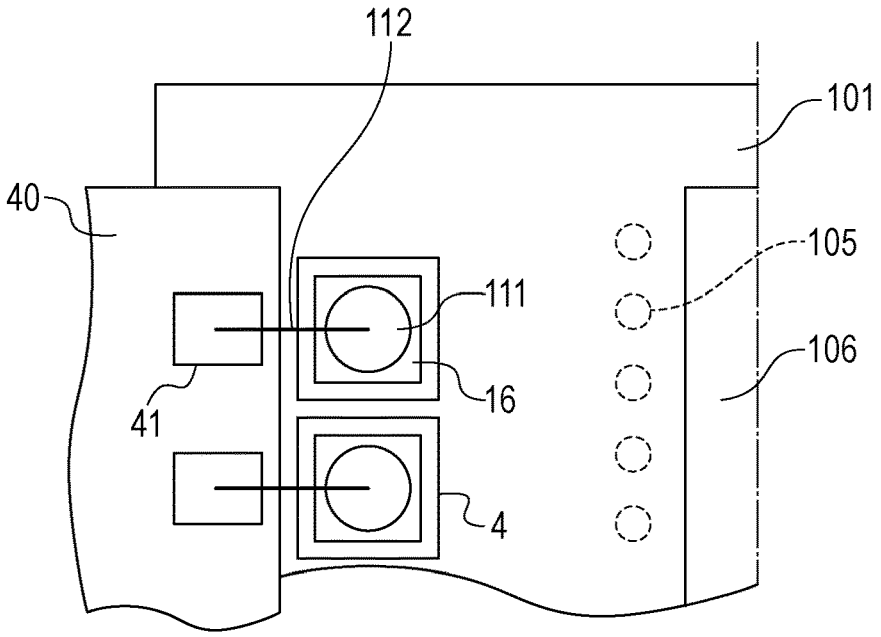
FIG. 3B is a schematic view of the element substrates viewed from IIIB-IIIB in FIG. 3A.

FIG. 3A is a schematic view of the liquid ejection head 3 illustrating a portion of a cross section taken along line IIIA-IIIA in FIG. 2B. FIG. 3B is a schematic plan view of the element substrate 10 is viewed from in FIG. 3A, and illustrates a state in which the sealing member 113 is omitted to facilitate the description. As illustrated in FIG. 3A, the liquid ejection head 3 is mainly constituted by the element substrates 10 and the liquid flow path members 120. The element substrate 10 is mainly constituted by an ejection port forming member 103 in which ejection ports 105 that eject a liquid are formed, a wiring layer 107, and a silicon base portion 101. The wiring layer 107 is configured to electrically connect heaters 104, which are energy generating elements that supply energy to a liquid near the ejection ports 105, and the terminals 16 to each other. Note that each heater 104 and the corresponding terminal 16 may be electrically connected to each other with a transistor (not shown) and various circuits may be provided in between. The liquid flow path member 120 is a member that forms a flow path that supplies the liquid, which is to be ejected from the ejection ports 105, to the element substrate 10. An ink supply port 106 is a portion that becomes a flow path of the ink supplied to the ejection ports 105 and is formed on a back surface side of the element substrate. The electric wiring members 40 are provided on the back surface side of the element substrates.

Hole portions 4 drilled from the back surface to the terminals 16 are provided in a surface (a second surface) of the base portion 101, which is a surface on the opposite side with respect to a surface (a first surface) in which the terminals and the energy generating elements are provided. In other words, the terminals 16 are provided in bottom portions of the hole portions 4. Each terminal 16 and one end portion of the corresponding electric connection member 112 are electrically connected to each other, and the other end portion of the electric connection member 112 is electrically connected to the terminal 41 of the corresponding electric wiring member 40. In the present example embodiment, each electric connection member 112 is an Au wire, and is connected to the corresponding terminal 16 and the corresponding terminal 41 by a so-called wire bonding method. Note that the electric connection member 112 is not limited to an Au wire, and may be either one of gold, copper, aluminum, and silver, or may be an alloy of at least any two of the above four metals. The sealing members 113 are formed inside the hole portions 4 so as to cover the terminals 16, the terminals 41, and the electric connection members 112. Electric power is supplied from the electric wiring members 40 to the heaters 104 by electrically connecting the terminals 16 and the terminals 41 to each other with the electric connection members 112. Furthermore, an Au ball 111 is connected to a tip of each Au wire. The liquid flow path members 120 and the element substrates 10 are adhered to each other with an adhesive agent 121 in between. Other than the function of adhering the liquid flow path members 120 and the element substrates 10 to each other, the adhesive agent 121 also has a function of sealing between the liquid flow path members 120 and the element substrates 10 so that the ink of the ink supply ports 106 does not flow therebetween. Furthermore, although the sealing members 113 and the adhesive agent 121 are, for example, formed of an epoxy resin, the sealing members 113 and the adhesive agent 121 may be formed of different materials. The terminals 16 or the terminals 41 can be formed of either one of gold, copper, and aluminum, or of an alloy of at least any two of the above three metals. Alternatively, the terminals 16 or the terminals 41 can be formed of an alloy of at least one of the above metals, namely, gold, copper, and aluminum, and silicon.

Subsequently, referring to FIG. 3A, a focus will be given on an interface between the sealing member 113 or the adhesive agent 121 and the base portion 101. As illustrated in the drawing, there are three interfaces, namely, a surface a that forms an interface with the adhesive agent 121, a surface b that is a sidewall of the hole portion 4 and that is formed in a depth direction, and a surface c that is a bottom portion of the hole portion and that is formed along the bottom portion. As described above, when the positions and the orientation of the planes of the different interface are different, even if force that peels a specific interface is applied, the interface that is peeled can be limited to only a portion. For example, even when force (shearing force) that peels the interface a is applied and the interface a becomes peeled, peeling of the interface b, which is a surface that intersects the interface a, is suppressed. Accordingly, even if external force or the like is applied, since peeling of the entire interfaces from the ink supply port 106, where there is ink, to the terminal 16 is prevented, adhesion of the ink to the terminal 16 or the electric connection member 112 is suppressed and the reliability of the element substrate 10 against the liquid can be obtained. In other words, the ink can be prevented from reaching the electric connection portion between the terminal 16 and the electric connection member 112. Furthermore, the number of interfaces does not necessarily have to be three, and it is only sufficient that there are at least two interfaces, namely, the surface b formed in the depth direction of the hole portion and the surface c formed in the direction extending along the bottom portion. It is more desirable that there are three interfaces a, b, and c. If the terminal 16 is formed on the surface a, the ink from the ink supply port 106 will easily become adhered to the terminal 16 by mere peeling of the adhesive agent 121.

As illustrated in FIG. 3A, in the present example embodiment, the sealing member 113 is filled inside the entire hole portion 4. Accordingly, for example, during a cleaning operation of the liquid ejection head, even if force in the direction parallel to the principal plane of the element substrate 10 is applied, an inner wall surface of the hole portion 4 serves as an obstacle that prevents the sealing member 113 from moving. On the other hand, wall surfaces or the like are not formed on both sides of the adhesive agent 121 in the direction parallel to the principal plane of the element substrate 10. Accordingly, even if the interface a is peeled due to a cleaning operation or the like, the peeling is prevented from proceeding to the bottom portion c of the hole portion 4. Furthermore, the wall surfaces do not have to be formed of different members or materials, and the interfaces can be formed in a stable manner with a material that is the same as that of the base portion 101. It is desirable that the surface that forms the sidewall of the hole portion 4 is formed substantially perpendicular to the principal plane of the element substrate 10 (for example, the back surface of the element substrate 10). Furthermore, the sidewall of the hole portion 4 is at least formed preferably at an angle of 45 degrees or less against the line normal to the back surface of the element substrate 4, and is more preferably formed at an angle of 10 degrees of less. As in the example embodiment, by using a flexible connection member such as the Au wire for the electric connection member 112, disconnection of the wire can be prevented by deformation of the wire member even when various types of force are applied; accordingly, the reliability of the electric connection can be obtained.

A description has been given above iii which the hole portions 4 each have a square shape (a square pole) in FIGS. 3A and 3B; however, the hole portions 4 are not limited to a square shape and may be of various shapes. For example, even with a circular (cylindrical) hole, similar to the square hole portion, two surfaces, namely, the surface b that is the sidewall of the hole portion and the surface c that is the bottom portion are formed as the interfaces; accordingly, an effect of suppressing peeling of the interfaces is obtained.

Electric Connection Through Flying Lead

Figure 4:
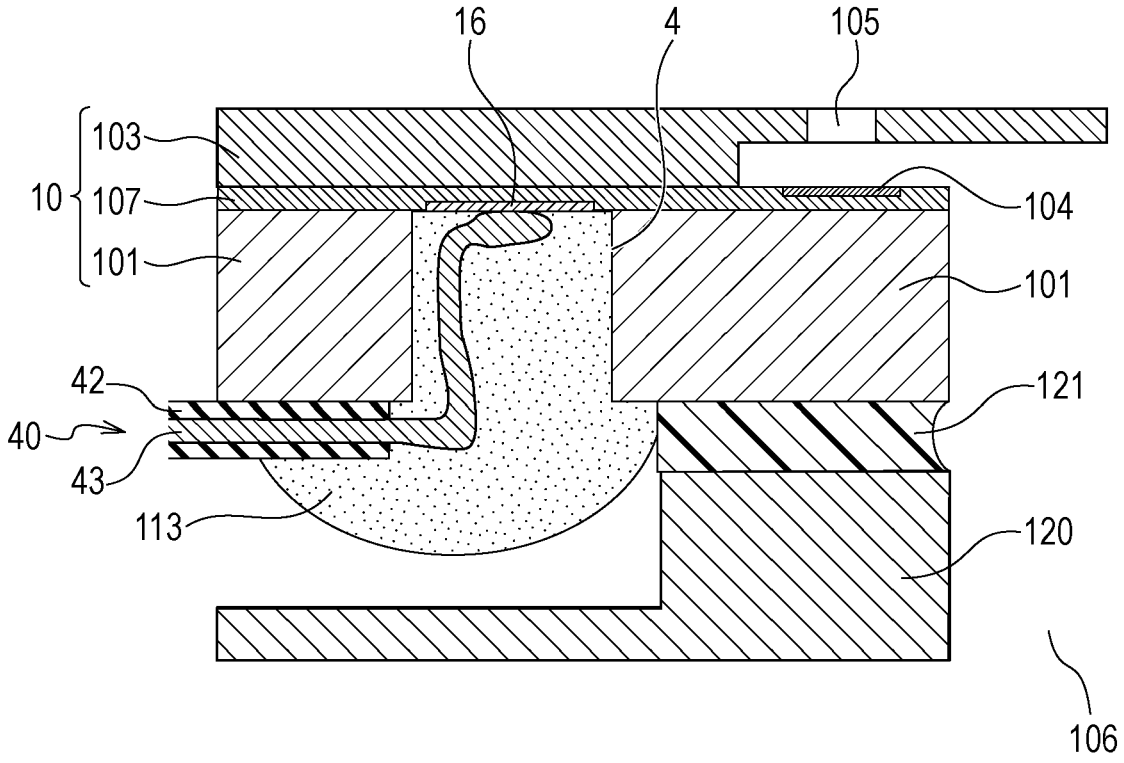
FIG. 4 is a schematic view of a liquid ejection head according to a modification of the first example embodiment.

In the example embodiment described above, a configuration in which the element substrates 10 and the electric wiring members 40 are connected to each other by wire lead bonding has been described; however, the present disclosure is not limited to the above configuration and various configurations of electrical connection can be applied. As a modification of the present example embodiment, a schematic view of an electrical connection by flying lead bonding is illustrated in FIG. 4. In the present modification, a so-called TAB wiring is used as the electric wiring member 40. As illustrated in the drawing, the TAB wiring includes a wiring member 43 interposed between film-like insulating members 42 (a base film and a cover film) formed of resin and the like, and one end of the wiring extends outwards from an end portion of the TAB wiring. A flying lead that is an extension portion of such wiring is electrically connected by bonding to the terminal 16 formed at the bottom portion of the hole portion 4 of the element substrate 10, and the electric connection portion is sealed by the sealing member 113. Even with such a configuration, reliability against the liquid can be obtained as long as the plurality of interfaces described above are formed.

DESCRIPTION OF MANUFACTURING METHOD

Figure 5:
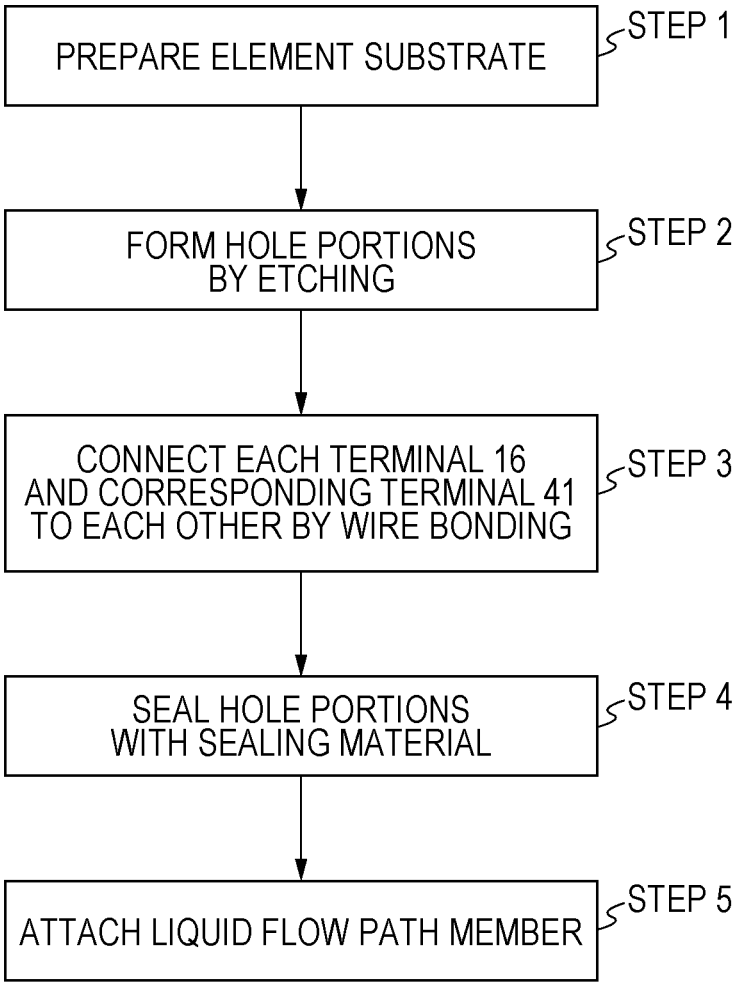
FIG. 5 illustrates a flow of the steps of the manufacturing method of the liquid ejection head according to the first example embodiment.
Figure 6A:
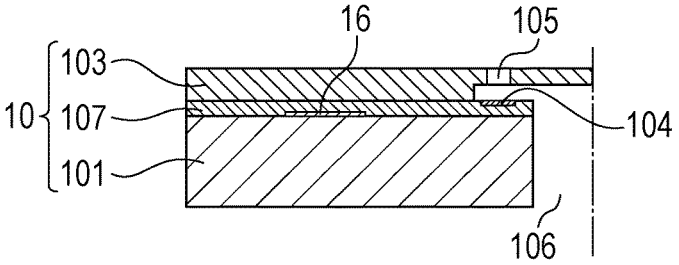
FIG. 6A is a schematic view illustrating step 1 in FIG. 5.

A method of manufacturing the liquid ejection head 3 according to the present example embodiment will be described next. FIG. 5 illustrates a flow of the steps of the manufacturing method, and FIGS. 6A to 6E illustrate schematic views of the manufacturing method. As illustrated in FIG. 6A, first, the element substrate 10 in which the wiring layer 107 and the terminals 16 have been formed is prepared (step 1 in FIG. 5). Aluminum alloy portions serving as metal portions that are to become the terminals 16 are formed on the base portion 101 side of the wiring layer 107 of the element substrate 10. The thickness of each aluminum alloy portion is about 600 nm. Note that the metal portion is not limited to an aluminum alloy and may be gold or copper. Furthermore, the metal portion may be an alloy of at least two of the metals among the three metals, namely, gold, copper, and aluminum.

Figure 6B:
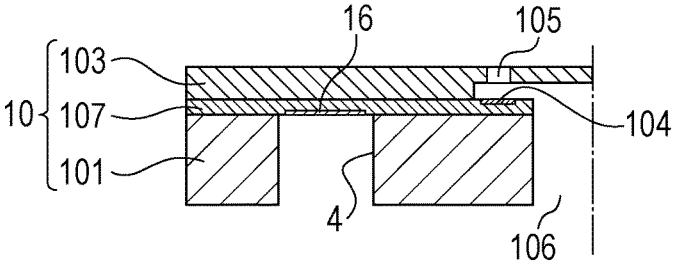
FIG. 6B is a schematic view illustrating step 2 in FIG. 5.

Subsequently, after forming a resist (not shown) on the base portion 101, portions of the resist where the hole portions 4 are formed is removed by photolithography. Subsequently, as illustrated in FIG. 6B, the hole portions 4 are formed in a back surface of a Si substrate, which is the base portion 101, using dry etching for Si such as a BOSH process. Furthermore, since an insulating layer (not shown) of a silicon oxide film is formed between the terminals 16 and the base portion 101, the insulating layer is also removed by oxide film etching (step 2 in FIG. 5).

Figure 6C:
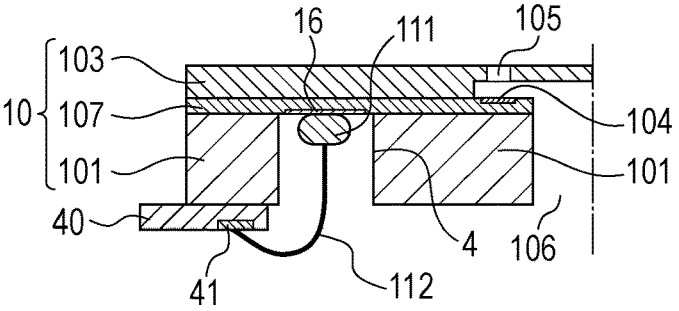
FIG. 6C is a schematic view illustrating step 3 in FIG. 5.
Figure 6D:
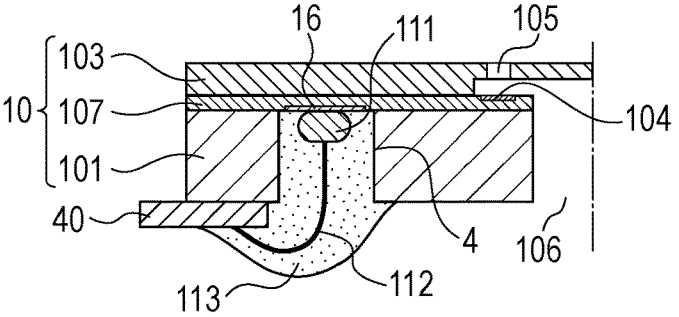
FIG. 6D is a schematic view illustrating step 4 in FIG. 5.

Subsequently, as illustrated in FIG. 6C, the electric wiring member 40 is attached to the base portion 101 on the side, with respect to the hole portion 4, opposite to the side on which the ink supply port 106 is provided. A bonding tool is inserted into each hole portion 4, and the terminal 41 and the terminals 16 of the corresponding electric wiring member 40 is connected to each other by wire bonding using an Au wire (step 3 in FIG. 5). Subsequently, as illustrated in FIG. 6D, the sealing member 113 is injected inside the hole portions 4 to insulate and seal the insides of the hole portions 4 and the portions around the Au wires 112, and baking is performed to harden the above (step 4 in FIG. 5)

Figure 6E:
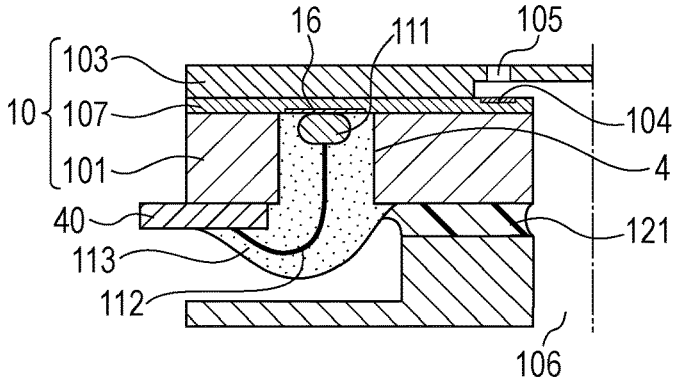
FIG. 6E is a schematic view illustrating step 5 in FIG. 5.

After the above, as illustrated in FIG. 6E, a thermosetting adhesive agent is used to bond the liquid flow path members 120 and the element substrates 10 to each other to complete the manufacturing of the liquid ejection head 3 (step 5 in FIG. 5). Note that the ink supply ports 106 and the ejection port forming member 103 may be formed after the hole portions 4 have been formed.

Second Example Embodiment

Figure 7:
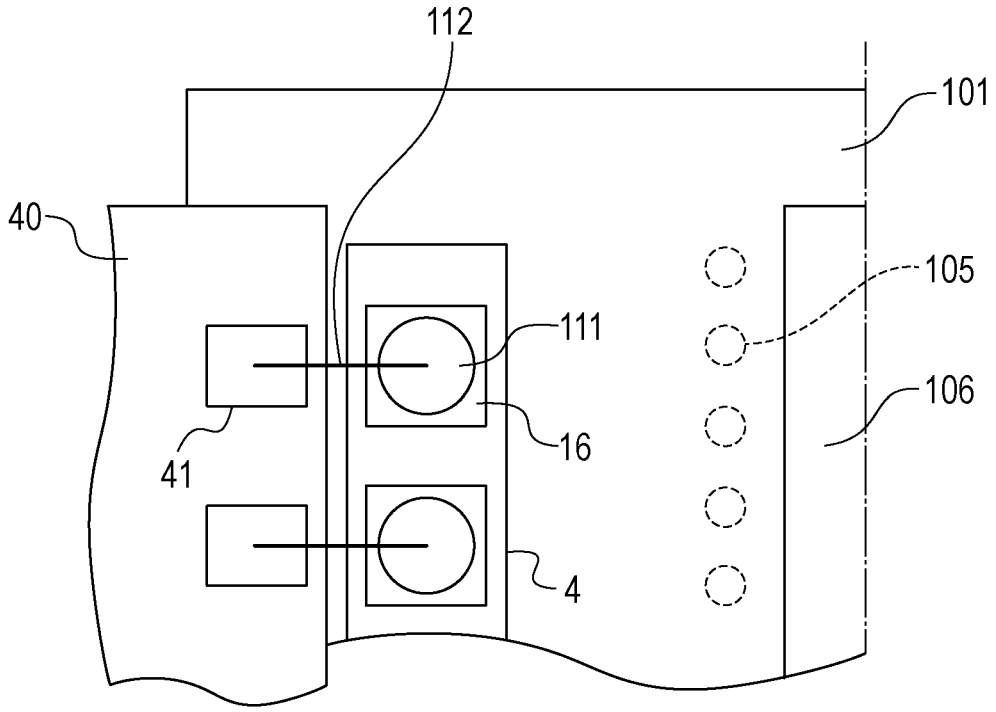
FIG. 7 is a schematic view of a liquid ejection head according to a second example embodiment.

A liquid ejection head according to a second example embodiment will be described with reference to FIG. 7. Components similar to those of the first example embodiment will be attached with the same reference numeral and description thereof will be omitted. FIG. 7 is a plan view of the liquid ejection head according to the present example embodiment viewed from the same portion as that in VII-VII in FIG. 3A. In the present example embodiment, a plurality of terminals 16 are formed on a bottom portion of a single hole portion 4. Although a plurality of Au wires 112 are formed inside the hole portion 4, since the hole portion 4 is filled with the insulating sealing member 113, electrical insulation is obtained. With the above, the footprint can be reduced in size, which is suitable from the viewpoint of miniaturization. In the above, the terminals 16 do not necessarily have to be aligned in a row. For example, it is desirable that the terminals 16 are arranged in a staggered manner since the length in the row direction can be reduced.

Third Example Embodiment

Figure 8A:
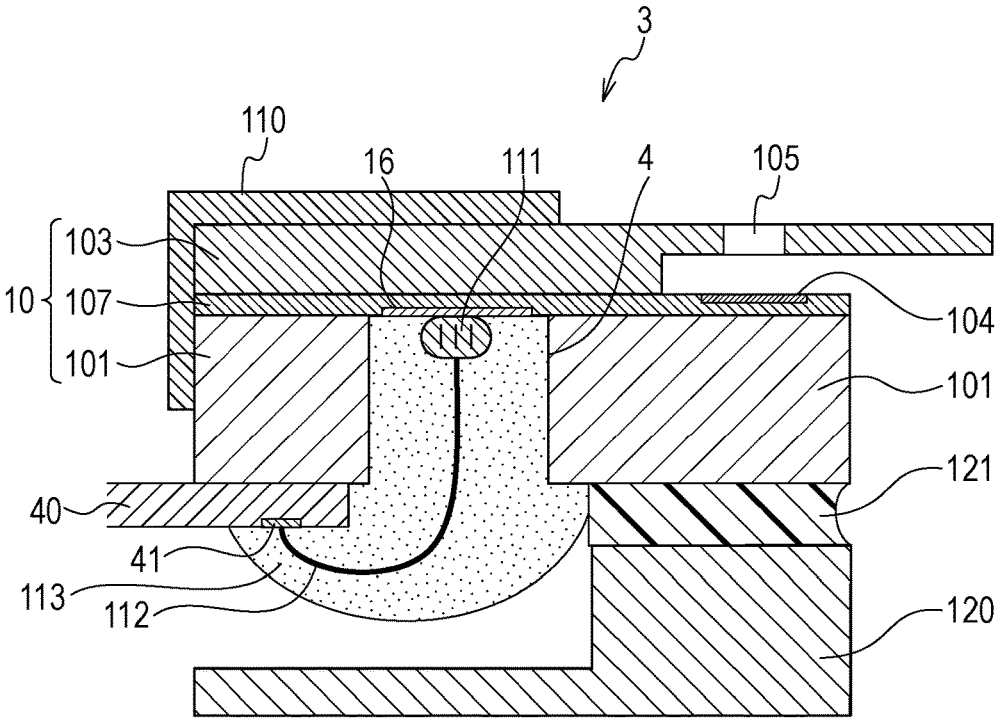
FIG. 8A is a schematic view of a liquid ejection head according to a third example embodiment.
Figure 8B:
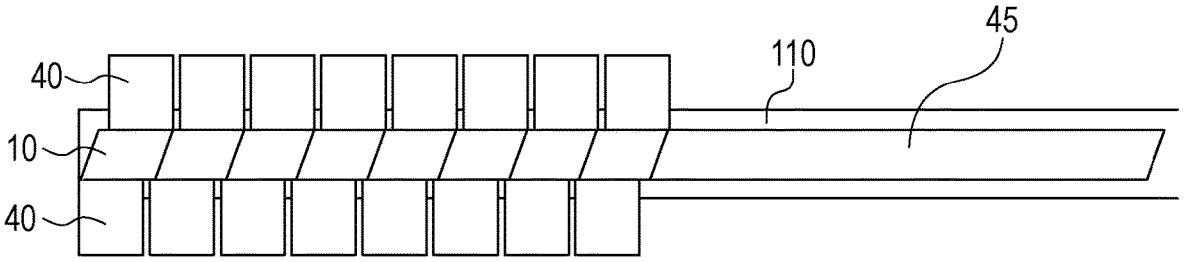
FIG. 8B is a schematic view illustrating a fixing member.

A liquid ejection head according to a third example embodiment will be described with reference to FIGS. 8A and 8B. Components similar to those of the first example embodiment will be attached with the same reference numeral and description thereof will be omitted. The future of the present example embodiment is that each element substrate 10 is attached to a fixing member 110. FIG. 8A is a schematic view of the liquid ejection head 3 according to the present example embodiment and is a cross section taken along line VIIIA-VIIIA in a portion similar to that in FIG. 2B. FIG. 8B is a schematic view in which the plurality of element substrates 10 attached to the fixing member 110 and the fixing member 110 are viewed from the back surface side of the element substrates 10. Note that in FIG. 8B, for the sake of description, a state in which some of the element substrates 10 and the electric wiring members 40 are attached to the fixing member 110 is illustrated.

As illustrated in FIG. 8B, the fixing member 110 has a frame shape, and an inner surface side of the frame and the element substrates 10 are fixed to each other using an adhesive agent. In other words, the fixing member 110 is in contact with the surfaces (ejection port surfaces) of the element substrates 10 in which the ejection ports are formed. Furthermore, the fixing member 110 includes an opening 45 that exposes the ejection ports. A joining portion between the recording apparatus (not shown) and the liquid ejection head 3 is provided in a support member 5 (FIG. 1) that supports the fixing member 110. The fixing member 110 is attached to the support member 5. Furthermore, the element substrates 10 are attached to the fixing member 110. Accordingly, while a positioning standard of the element substrates 10 is the fixing member 110, since the joining portion with the liquid ejection head 3 is in the support member 5 situated in the vicinity of the fixing member 110, the influence of dimensional tolerances of various components of the liquid ejection head 3 on the positional accuracy of the element substrates 10 is small. Accordingly, the positional accuracy of the element substrates 10 with respect to the recording apparatus can be improved. Furthermore, from the viewpoint of dimensional accuracy, it is desirable that the joining portion between the recording apparatus and the liquid ejection head 3 is provided in the fixing member 110 since the distance between the joining portion and the element substrates 10 is smaller.

Furthermore, in each of the example embodiments described above, since the hole portions 4 are provided in the back surfaces of the element substrates 10 and the terminals 16 are formed at the bottom portions thereof, the strength of the above portions may decrease. In the present example embodiment, the fixing member 110 is provided so as to correspond to the positions where the hole portions 4 (the terminals 16) are provided. The above is desirable since with the above, the strength of the element substrates 10 in the hole portions 4 is improved. While various materials such as resin, metal, or the like can be applied as the material of the fixing member 110, metal such as stainless steel (SUS) is desirable from the viewpoint of strength. Furthermore, while resin is applicable, from the viewpoint of strength, it is desirable that resin containing filler is applied. When SUS is used in the fixing member 110, the thicknesses of the portions in contact with the ejection port surfaces is preferably 10 μm or more from the viewpoint of strength. Furthermore, since itis desirable from the viewpoint of printing quality to reduce the distances between the ejection port surfaces and the print medium such as paper, the thickness of the fixing member 110 is preferably 100 μm or less.

Furthermore, when the terminals 16 and the electric wiring members 40 are electrically connected with the wire bonding method, since the electrical connection is performed by having the bonding tool be in contact with the terminals 16, stress is applied especially to the ejection port forming member. Since the fixing member 110 is situated at positions where the terminals 16 (the hole portions 4) are provided, the ejection port forming member can withstand the stress caused by the wire bonding method; accordingly, deformation of the ejection port forming member can be suppressed.

While the plurality of terminals 16 are formed in the liquid ejection head illustrated in FIG. 1, not all of the terminals need to be disposed at the bottom portions of the hole portions 4, as described above. The configuration of the present disclosure can be applied to at least one of the terminals 16.

The present disclosure is capable of providing a liquid ejection head having reliability against the liquid in the electric connection portions of the element substrates.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-103909 filed May 30, 2018, which is hereby incorporated by reference herein in its entirety.

What is claimed is:

1. A liquid ejection head comprising:

an element substrate including an ejection port forming member having an ejection port that ejects a liquid, a wiring layer that electrically connects an energy generating element that generates energy to eject the liquid from the ejection port and a terminal to each other, and a base portion; and an electric connection member that is connected to the terminal and that supplies electric power that drives the energy generating element to the energy generating element from a portion external to the element substrate, wherein the base portion includes a hole portion, and, among surfaces of the base portion, the hole portion is formed from an opposite surface of the base portion to the terminal, wherein the opposite surface is opposite of a surface that is in contact with the wiring layer, wherein a sealing member is provided inside the hole portion, the sealing member covering a connection portion between the terminal and the electric connection member, and wherein the liquid ejection head further includes a fixing member in contact with a surface in which the ejection port of the ejection port forming member is formed, the fixing member being provided at a position corresponding to the hole portion.

2. The liquid ejection head according to claim 1, wherein the fixing member includes an opening that exposes the ejection port.

3. The liquid ejection head according to claim 1, wherein the fixing member has a frame shape.

4. The liquid ejection head according to claim 1, wherein the fixing member is stainless steel.

5. The liquid ejection head according to claim 1, wherein the fixing member is a resin containing filler.

6. The liquid ejection head according to claim 1, wherein a thickness of a portion of the fixing member in contact with the surface in which the ejection port of the ejection port forming member is formed is 10 μm or more.

7. The liquid ejection head according to claim 1, wherein a thickness of a portion of the fixing member in contact with the surface in which the ejection port of the ejection port forming member is formed is 100 μm or less.

8. The liquid ejection head according to claim 1, further comprising:

an electric wiring member including wiring that supplies electric power to the energy generating element, wherein the electric connection member is a wire member that electrically connects the wiring and the terminal to each other.

9. The liquid ejection head according to claim 1, further comprising:

an electric wiring member including wiring that supplies electric power to the energy generating element, wherein the electric connection member is a flying lead in which the wire extends outwards from an end portion of the electric wiring member.

10. The liquid ejection head according to claim 1, wherein the sealing member covers the electric connection member.

11. The liquid ejection head according to claim 1, wherein the electric connection member is either one of gold, copper, aluminum, and silver, or is an alloy of at least any two of gold, copper, aluminum, and silver.

12. The liquid ejection head according to claim 1, further comprising:

a liquid flow path member including a supply port that supplies the liquid to the energy generating element, the liquid flow path member and the element substrate adhered to each other with an adhesive agent in between.

13. The liquid ejection head according to claim 1, wherein the sealing member is provided on the terminal and on a sidewall of the hole portion.

14. The liquid ejection head according to claim 1, wherein a surface forming a sidewall of the hole portion is formed substantially perpendicular to the opposite surface of the base portion.

15. The liquid ejection head according to claim 1, wherein an insulating layer is formed in an area between the wiring layer and the base portion other than between the terminal and the hole portion.

16. The liquid ejection head according to claim 1, wherein a plurality of the terminals are formed inside the hole portion.

17. The liquid ejection head according to claim 1, wherein the liquid ejection head is a page-wide liquid ejection head in which a plurality of the element substrates are arranged in a linear manner.

18. The liquid ejection head according to claim 8, wherein the electric wiring member is formed on the opposite surface of the base portion.

19. A method of manufacturing a liquid ejection head that ejects a liquid comprising:

preparing an element substrate that includes an ejection port forming member having an ejection port that ejects a liquid, a wiring layer having an energy generating element that generates energy to eject the liquid from the ejection port and a terminal electrically connected to the energy generating element through the wiring layer, and a base portion;

forming a hole portion by etching from, among surfaces of the base portion, an opposite surface of the base portion to the terminal, wherein the opposite surface is opposite of a surface that is in contact with the wiring layer;

connecting the terminal and an electric connection member to each other by inserting a tool inside the hole portion;

covering a connection portion between the terminal and the electric connection member with a sealing member by injecting the sealing member inside the hole portion; and attaching a fixing member to a surface in which the ejection port of the ejection port forming member is formed, the fixing member being provided at a position corresponding to the hole portion.

* * * * *